US006528176B1

(12) United States Patent
Asai et al.

(10) Patent No.: US 6,528,176 B1
(45) Date of Patent: Mar. 4, 2003

(54) STRUCTURE OF HEMMED TOGETHER METAL PLATE MATERIALS

(75) Inventors: Katsuhiko Asai, Aichi-ken (JP); Koichi Ishihara, Aichi-ken (JP)

(73) Assignee: Sanyo Machine Works, Ltd., Aichi (JP)

( * ) Notice: Subject to any disclaimer, the term of this patent is extended or adjusted under 35 U.S.C. 154(b) by 0 days.

(21) Appl. No.: 09/744,258

(22) PCT Filed: Jun. 9, 1999

(86) PCT No.: PCT/JP99/03078

§ 371 (c)(1),
(2), (4) Date: Jan. 31, 2001

(87) PCT Pub. No.: WO00/74872

PCT Pub. Date: Dec. 14, 2000

(51) Int. Cl.[7] ..... B21D 39/00; B23P 11/00; B32B 3/04; B32B 3/06

(52) U.S. Cl. ..... 428/582; 428/594; 428/598; 29/521

(58) Field of Search ..... 428/582, 597, 428/598, 603, 599, 594; 29/521, 509, 243.58

(56) References Cited

U.S. PATENT DOCUMENTS 2,120,470 A * 6/1938 Patterson ..... 206/140
3,861,339 A * 1/1975 Aida et al. ..... 29/505
3,862,490 A * 1/1975 Tsuneishi et al. ..... 29/505
3,909,918 A * 10/1975 Takizawa et al. ..... 29/509
3,909,919 A * 10/1975 Miyabayashi et al. ..... 29/509
3,982,373 A * 9/1976 Wilson et al. ..... 52/522
4,386,543 A * 6/1983 Walker, Jr. ..... 269/265
4,427,869 A * 1/1984 Kimura et al. ..... 219/86.9
4,916,284 A * 4/1990 Petrick ..... 219/121.64
5,237,734 A * 8/1993 Polon ..... 29/243.58
5,897,796 A * 4/1999 Forrest ..... 219/121.64

FOREIGN PATENT DOCUMENTS

JP 58-28737 * 2/1983
JP 4-237523 * 8/1992
JP 08-155564 * 6/1996

* cited by examiner

*Primary Examiner*—John J. Zimmerman
(74) *Attorney, Agent, or Firm*—Arent Fox Kintner Plotkin & Kahn, PLLC

(57) ABSTRACT

In a hemming structure of metal plate material with an edge portion (7) of an outer panel (6) hemmed over an edge portion (2) of an inner panel (1), the edge portion (2) of the inner panel (1) has an inside rise portion (3) having a surface plane (3') down-sloping towards an edge (4) thereof and the edge portion (7) of the outer panel (6) has an outside rise portion (8) telescopically fitted with the inside rise portion (3), a back plane (8') of the outside rise portion (8) abutting on the surface plane (3') of the inside rise portion (3).

10 Claims, 10 Drawing Sheets

FIG. 1A
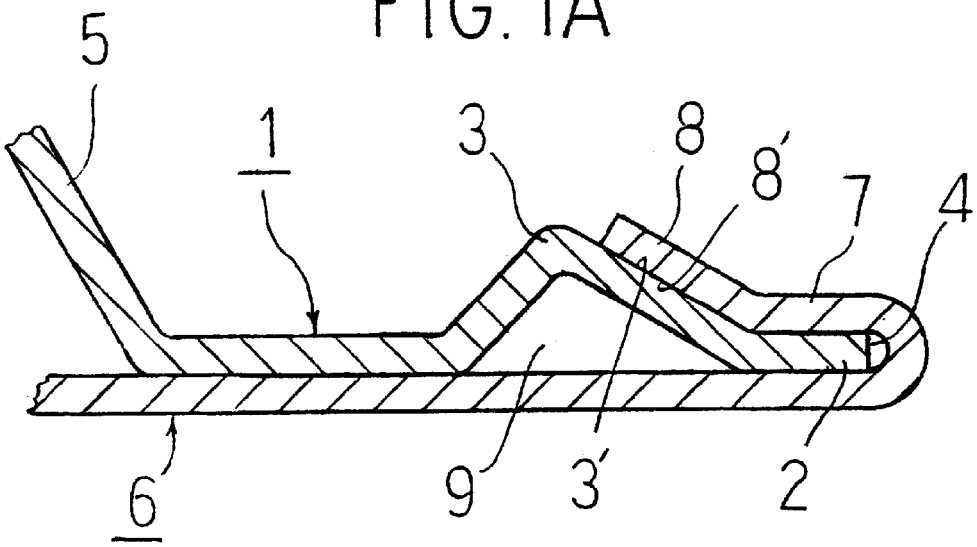
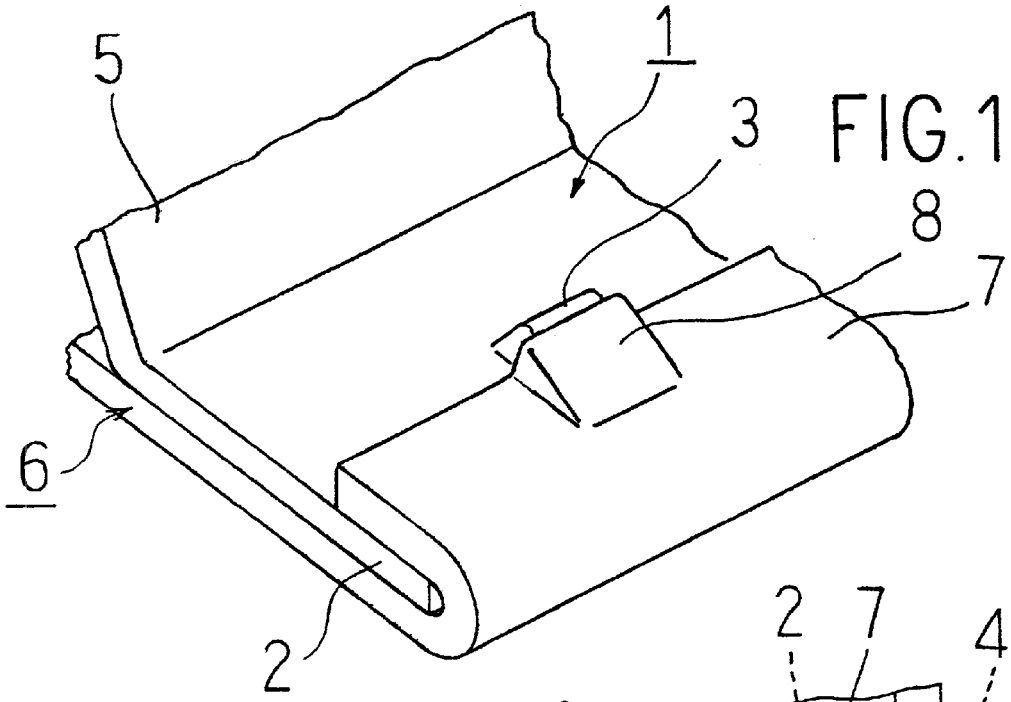
FIG. 1B
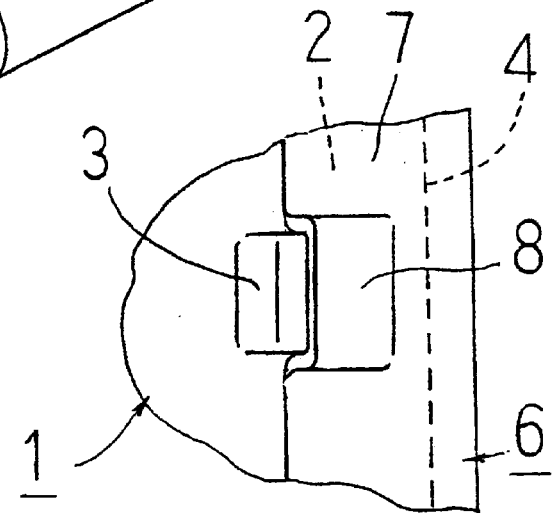
FIG. 1C

FIG.11A RELATED ART
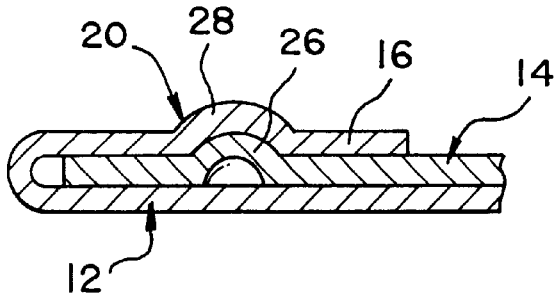
FIG.11B RELATED ART
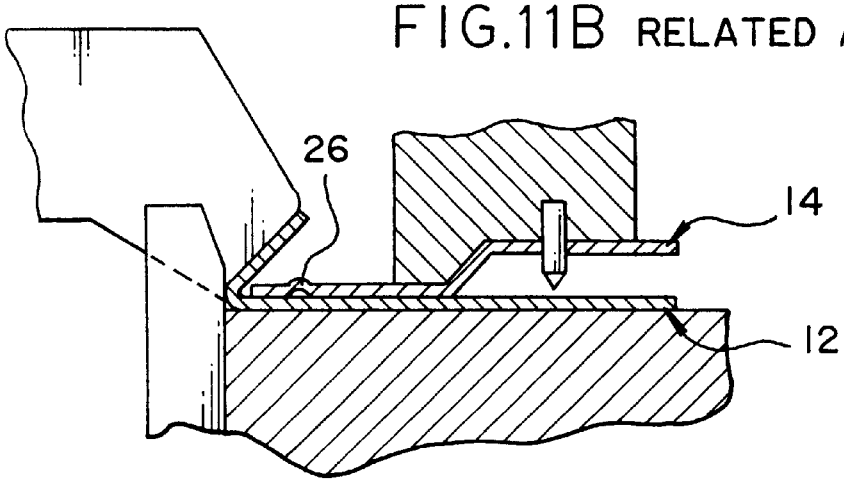
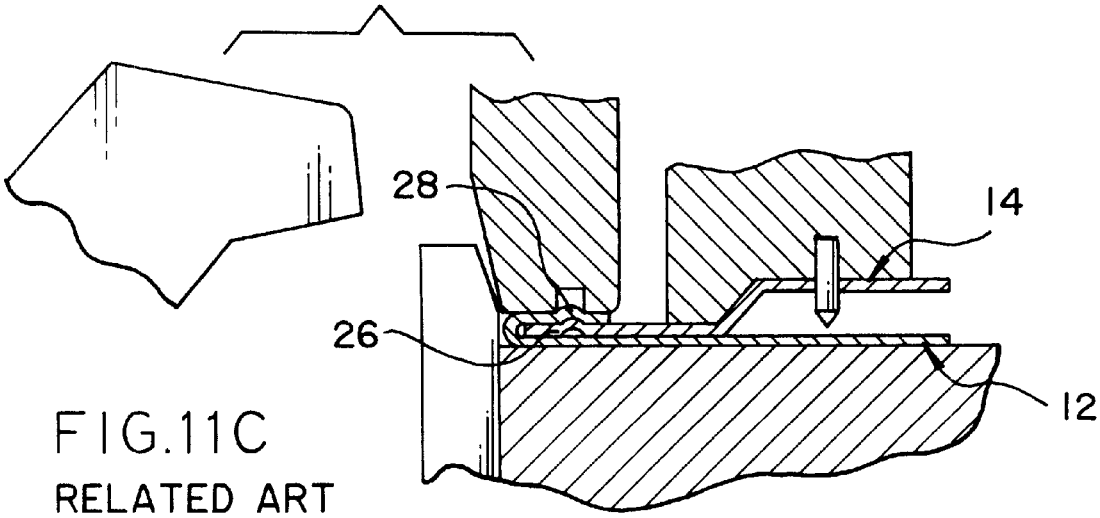
FIG.11C
RELATED ART

STRUCTURE OF HEMMED TOGETHER METAL PLATE MATERIALS

RELATED APPLICATIONS

This application is a 371 of PCT/JP99/03078 filed on Jun. 9, 1999.

BACKGROUND OF THE INVENTION

1. Field of the Invention

The present invention relates to a structure of hemmed together metal plate materials, for use of hemming of, for example, outer plates for automobiles such as engine hoods and door panels.

2. Description of Related Art

A hem structure of an outer plate for automobiles is usually formed by folding an edge of an outer panel over edge of an inner panel with a sealant or adhesive applied therebetween for the purpose of bonding. When a thermosetting resin is used as the adhesive, it is heated and cured in an oven or the like after the hemming process.

Thus, since the hemmed together pamels are transported to an oven or the like for curing after the hemming process, the hemmed together panels are not always retained as they are during transport. Accordingly, in order to retain the hemmed together pamels until the adhesive completely cures, it has been a conventional manner, for example, to dimple caulking or coining for the purpose of preventing relative movements between the panels (U.S. Pat. No. 5,237,734). As shown in FIGS. 11A~11C, in dimple caulking 20, a dimple 26 is formed on an inner panel 14 in advance (see FIG. 11B), then an outer panel 12 is turned and pressed to finish hemming (FIG. 11C), whereupon a hem flange 16 is subjected to plastic deformation along the dimple 26 as shown by reference numeral 28 (FIG. 11A).

However, interlocking the hemmed together panels by spot welding has a problem of thermal distortion as a result of welding heat. Particularly, the outer side of the outer panel is the surface of the product and is required to be carefully finished to have a good appearance. Accordingly, it becomes necessary to eliminate such distortion by surface finishing.

Also, in the method of dimple caulking, it is very difficult to make center alignment between the escape portion of a hemming die and the inner panel. That is, it is very difficult to make the hemming die pressing direction match the dimple shape of the press die, and after all, the job has to be done at the site. It is clear that generation of disalignment causes marks to remain on the outer surface of the outer panel. Furthermore, in the hemming process, there is no problem because of forming a dimple on the inner panel in advance, but the outer panel itself has a shape (for example, in the case of a door panel, it has a substantial curvature at the top close to the roof), there exists a problem that a dimple cannot be properly formed by a press that makes a vertical motion. Consequently, adaptable portions will be very much limited.

Furthermore, in order to more securely retain the panels, a dimple portion is sometimes welded as by a laser beam. In this case, however, the laser beam is applied to the spherical surface of the dimple and it is very difficult to control the height of the dimple and also to release the gas decomposed from the adhesive due to heat generated during laser welding or to control dimple clearance.

An object of the present invention is to provide a structure capable of reliably retaining the hemmed together panels without requiring any complicated operations.

DISCLOSURE OF THE INVENTION

The present invention provides a structure of hemmed together metal plate materials with an edge portion of an outer panel hemmed over an edge portion of an inner panel, characterized in that the edge portion of the inner panel has an inside rise portion having a surface plane down-sloping towards an edge thereof and the edge portion of the outer panel has an outside rise portion telescopically fitted with the inside rise portion, a back plane of the outside rise portion abutting on the surface plane of the inside rise portion. Here, the metal includes aluminum and other non-ferrous metals or alloy besides iron and steel.

In accordance with the present invention, the inside rise portion formed at the edge portion of the inner panel in advance is telescopically fitted with the outside rise portion formed during complete hem forming of the outer panel, thereby assuring reliable retention without deflection between the inner panel and the outer panel. Accordingly, even in the case of applying adhesive, both panels will be securely retained until the adhesive cures. Particularly, since a sturdy structure is formed in a way of caulking with the inside and outside rise portions fitted with each other, it is possible to completely prevent relative movement between the panels at least in a direction parallel to the edge of the inner panel.

As for the present invention, it can be said that the shape of a dimple in dimple caulking has been changed from a spherical surface to a plane surface. In a conventional method of dimple caulking, a spherical dimple is formed by pressing an inner panel, and an outer panel is similarly pressed and formed along the spherical profile, which will not assure a tight fitting finish. On the other hand, in the present invention, since the surface plane at top of the inside rise portion abuts on the back plane at top of the outside rise portion, the pressing direction and the caulking position can be freely determined, and moreover, it is possible to very easily perform laser welding or the like for complete retention after the caulking (hemming) process and to visually control and actually measure the clearance for escape of the gas decomposed from the adhesive that often causes a problem in quality assurance and execution of welding. Also, it becomes easier to adjust the strength of push against the hem by clamping both sides of the rise portion.

According to an embodiment of the present invention, the plane shape of the rise portions is rectangular. Two sides of a rise portion in a direction crossing the edge of an inner panel may be either parallel or non-parallel to each other (see FIG. 5). As an example of a non-parallel fashion, when the sides diverge as they approach the edge of the inner panel (FIG. 5B), which is advantageous in that the inner panel is prevented from displacing in the direction of removal in which it comes out of the hem flange of the outer panel.

According to an embodiment of the present invention, the inside rise portion is welded to the outside rise portion (FIG. 9). Since these rise portions are in plane-to-plane abutting relation with each other, it is easy to weld them tight to each other, for example, by laser welding. Also, because of a space existing between the inside rise portion and the outer panel, there is no fear of affecting the surface of the outer panel due to heat generated during the welding operation.

BRIEF DESCRIPTION OF DRAWINGS

FIG. 1A is a cross-sectional view of a hemming structure showing an embodiment of the present invention.

FIG. 1B is a perspective diagram,

FIG. 1C is a top plan view.

FIGS. 11A~11C are explanatory diagrams of prior art.

BEST MODE FOR CARRING OUT THE INVENTION

Figure 2A:
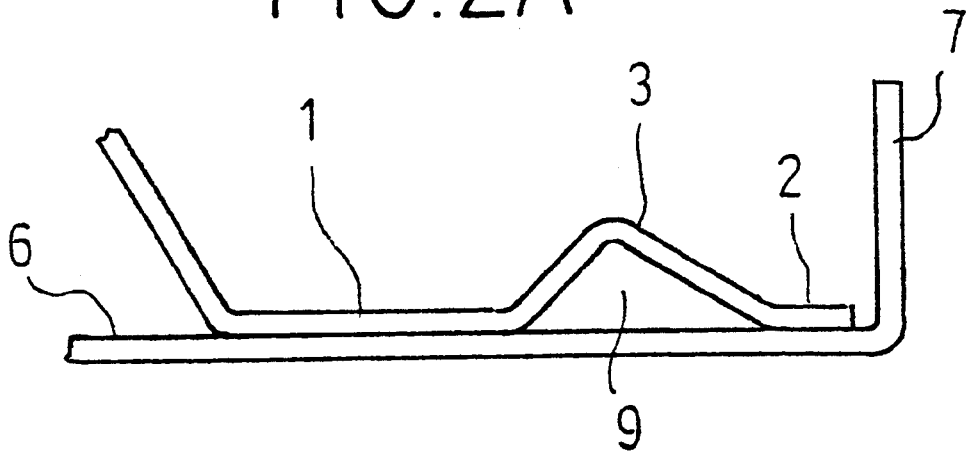
FIGS. 2A~2C are diagrams of hemming process.

In FIGS. 1A~1C is shown a hemming structure of an outer plate for automobiles, comprising an inner panel 1 and an outer panel 6 bonded to each other by hemming at edge portions 2 and 7.

A process of hemming is executed by placing the inner panel 1 on the outer panel 6 and by bending the edge portion 7 of the outer panel 6 over the edge portion 2 of the inner panel 1. Generally, there is provided an adhesive layer of thermosetting resin type between both edge portions 2 and 7. Here, the inner panel 1 is formed in such a manner that the inner side 5 located inward the edge portion 2 is bent to make the inner side apart from the outer panel 6.

At the edge portion 2 of the inner panel 1 is formed an inside rise portion 3 projecting away from the outer panel. Here, the cross-section of the inside rise portion 3 is inverted V-shaped, and a triangular space 9 is formed between the inside rise portion and the outer panel 6. The slope on an edge 4 side of the inner panel 1 is a plane down-sloping towards the edge 4. Also, at the edge portion 7 of the outer panel 6 is formed an outside rise portion 8 that matches and complementary to the inside rise portion 3. Thus, the inside rise portion 3 and the outside rise portion 8 are telescopically fitted with each other, and a surface plane 3' of the inside rise portion 3 is in plane-to-plane abutting relation with a back plane 8' of the outside rise portion 8.

As is seen in FIG. 1C, the plane shapes of the inside rise portion 3 and the outside rise portion 8 are rectangular. A square plane shape comprising two sides parallel to the edge 4 and two sides right-angled to the edge 4 is shown here as an example. The length in a direction along the edge 4 of the rise portions 3, 8 can be freely determined. Since the planes 3' and 8' of the rise portions 3, 8 abut against each other, the inner panel 1 is prevented from displacing to the right in FIG. 1A. Also, the relative movement of both panels 1 and 6 in a direction vertical to the illustration of FIG. 1A is prevented by the rise portions 3, 8.

Figure 5C:
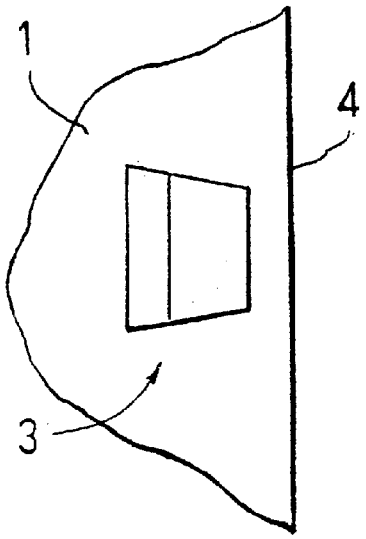
FIGS. 5A~5C are top plan views of an inside rise portion formed in different fashions.
Figure 5A:
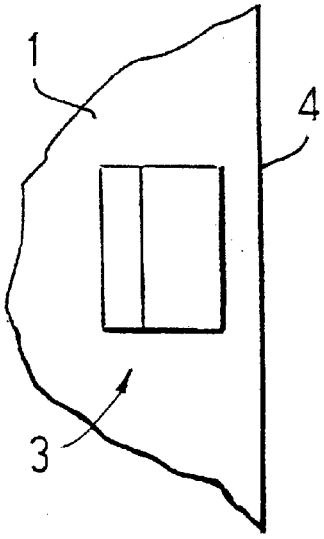
Figure 5B:
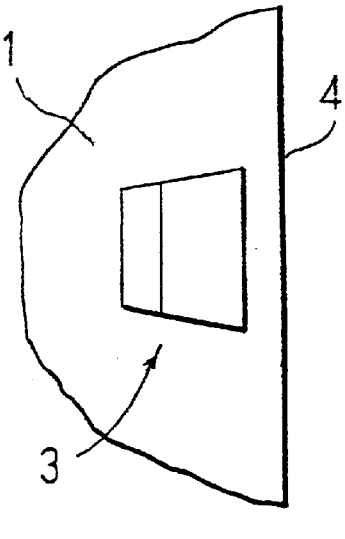

The two sides extending in a direction crossing the edge 4 of the rise portions 3, 8 may be either parallel as shown in FIG. 1C or non-parallel to each other. FIGS. 5A–5C show three forms of the plan view of the inside rise portion 3. In FIG. 5A, two sides extending in a direction crossing the edge 4 are parallel to each other and perpendicular to the edge 4. FIG. 5B and FIG. 5C show typical examples wherein the two sides are non-parallel to each other. Particularly, when the two sides diverge as they approach the edge 4 as shown in FIG. 5B, the inner panel 1 is unable to move apart from the outer panel 6 in FIG. 1A and accordingly an effect to further reliably prevent relative movements between the panels 1 and 6 may be obtained.

A process of hemming to form the structure of the present embodiment will now be described with reference to the sequential illustrations of FIGS. 2A~2C.

Figure 3:
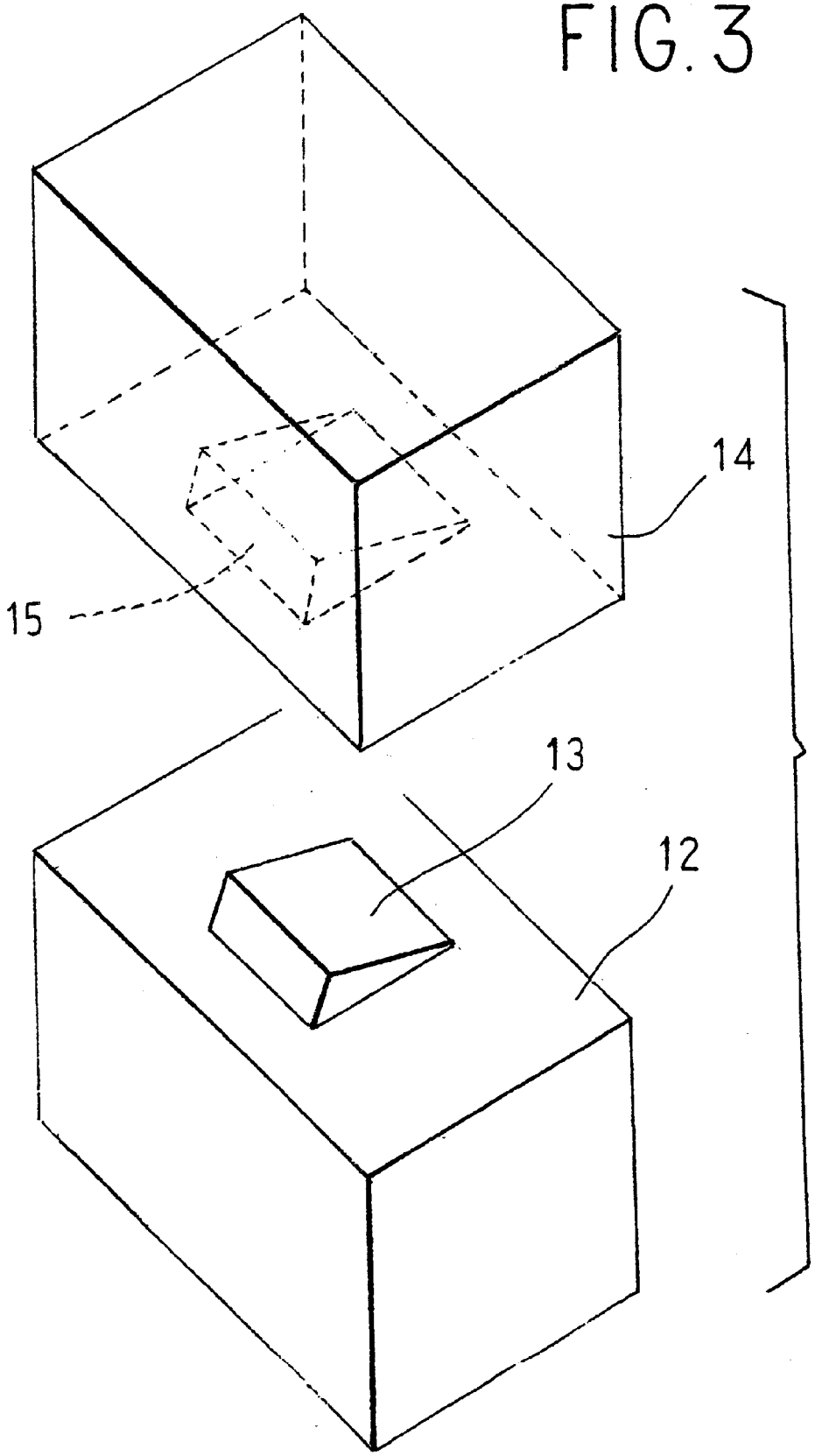
FIG. 3 is a perspective diagram of a pair of press dies.
Figure 4:
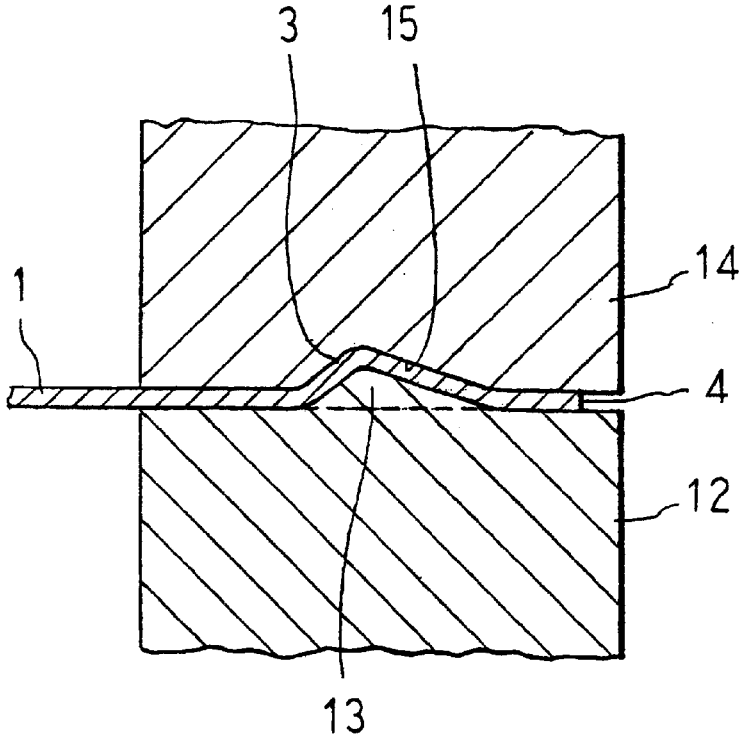
FIG. 4 is a cross-sectional view of an inside rise portion completed by the dies shown in FIG. 3.

The inside rise portion 3 is formed in advance at the edge portion 2 of the inner panel 1 by pressing. The pressing operation may be performed either during a process of pressing the inner panel 1 or after mounting the predetermined parts on the inner panel 1. In FIG. 3 is shown an example of a set of press dies to form the inside rise portion 3 of the inner panel 1. A lower die 12 includes a projection 13 having a shape just like a triangle pole lying thereon at the top end. An upper die 14 includes a depression 15 formed at the bottom end, whose shape corresponds to that of the projection 13 allowing for the thickness of the inner panel 1.

Figure 2B:
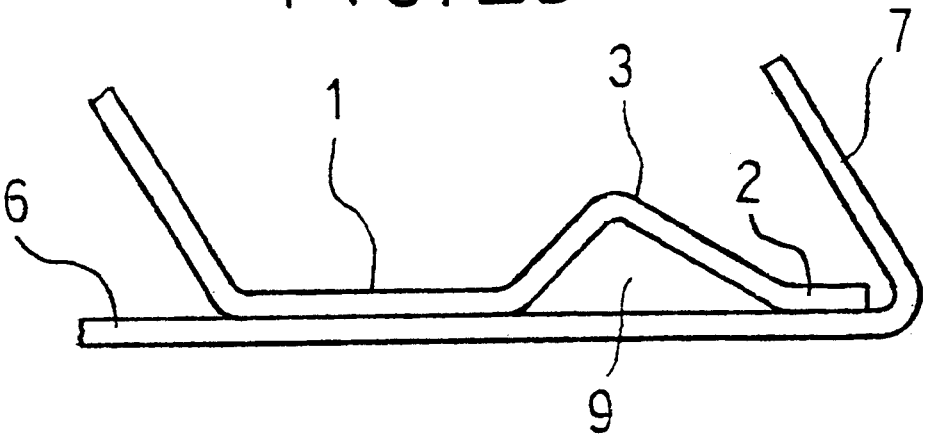
Figure 2C:
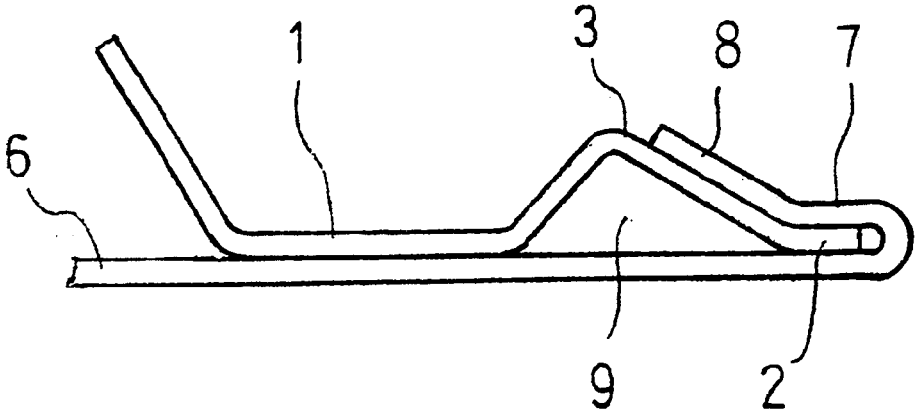
Figure 6A:
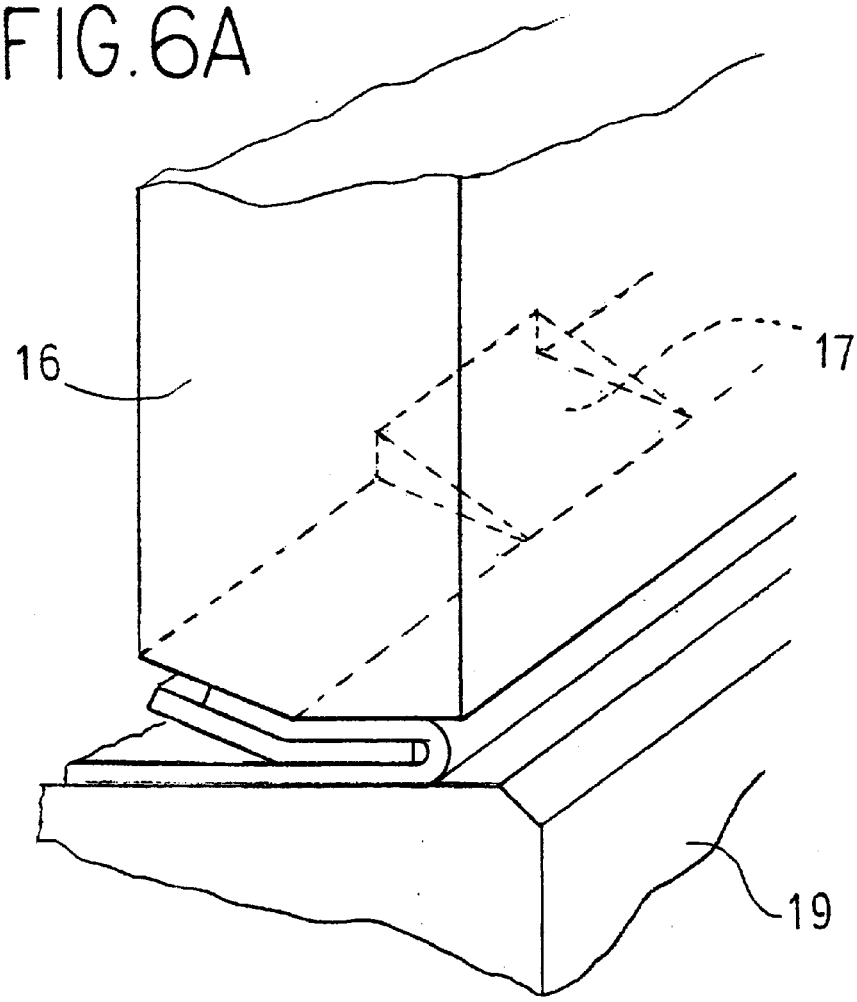
FIG. 6A is a perspective diagram of a main punch.
Figure 6B:
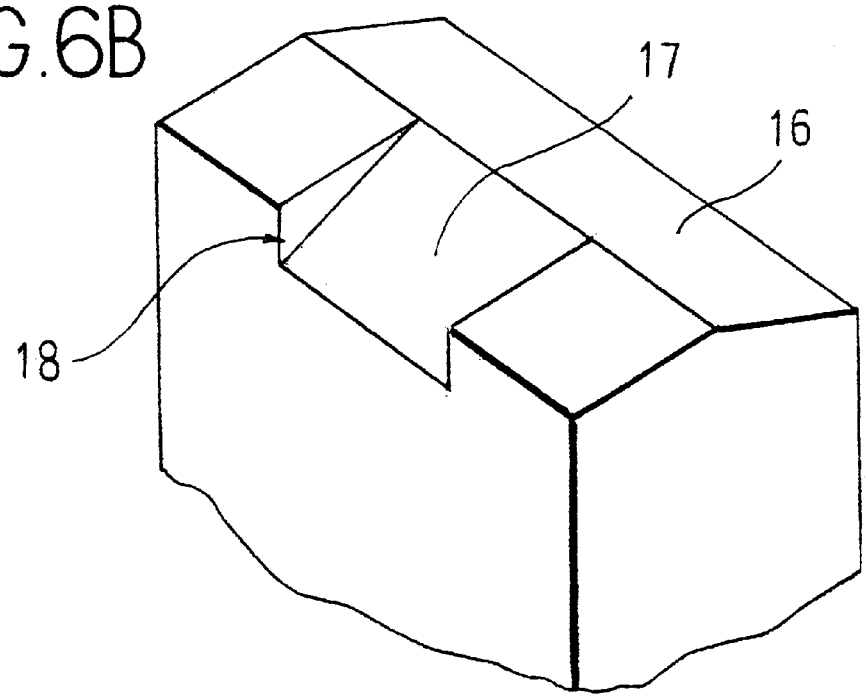
FIG. 6B is a bottom view of the main punch shown in FIG. 6A.

After the outer panel 6 and the inner panel 1 are set on a press block (FIG. 2A), pre-hemming is performed to turn the edge portion 7 of the outer panel 6 up to a certain extent (FIG. 2B). When adhesive is used, the adhesive is applied to both edge portions 2 and 7 prior to pre-hemming. Next, complete hemming is performed to completely turn the edge portion 7 of the outer panel 6 by a main punch 16 (FIG. 2C, FIG. 6A). As shown in FIG. 6B, an escape 18 formed in a forming surface 17 of the main punch 16 at a position corresponding to the inside rise portion 3 of the inner panel 1 allows the outside rise portion 8 corresponding to the inside rise portion 3 to be formed at the hem portion of the outer panel 6 during the complete hemming process, thereby creating what is called a caulking structure. Incidentally, reference numeral 19 in FIG. 6A designates a lower die. Thus, the caulking structure wherein the inside rise portion 3 formed at the edge portion 2 of the inner panel is fitted with the outside rise portion 8 formed at the edge portion 7 of the outer panel interlocks the panels 1 and 6.

The outside rise portion 8 is telescopically fitted with the inside rise portion 3 with the surface plane 3' of the inside rise portion 3 in plane-to-plane contact with the back plane 8' of the outside rise portion 8. Accordingly, unlike the case of a spherical dimple in prior art, the inside and outside rise portions 3 and 8 closely abut on each other allowing laser welding to be used. Moreover, a space 9 between the inside rise portion 3 and the outer panel 6 obviates any thermal distortion that may otherwise be caused by welding at the surface of the outer panel 6. Also, this eliminate the necessity of any after treatment such as surface finish of weld zones.

Figure 7A:
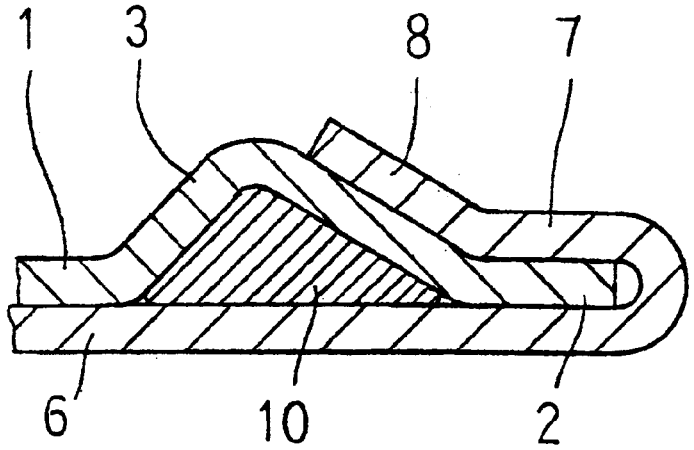
FIGS. 7A~7C are cross-sectional views of another embodiments.
Figure 7B:
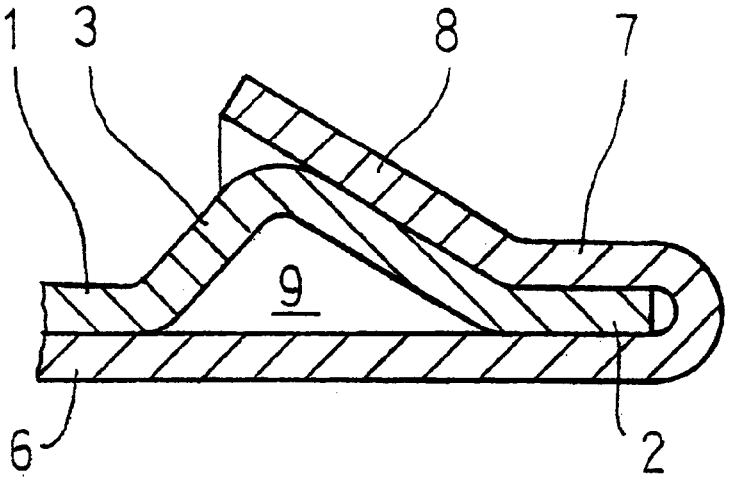
Figure 7C:
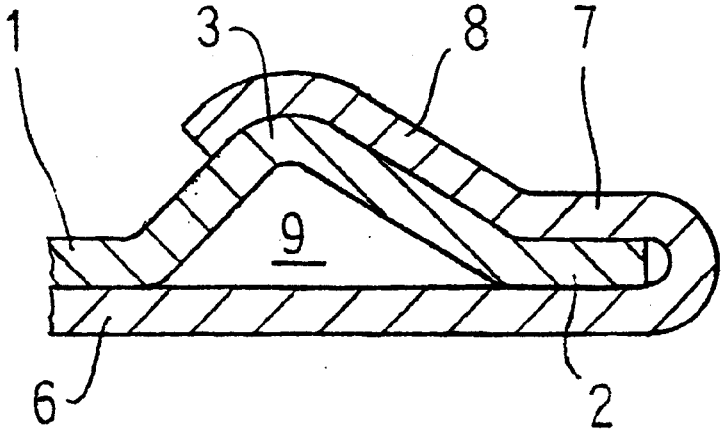

FIGS. 7A~FIG. 7C show various modifications. As shown in FIG. 7A, a filler or a support 10 may be filled into the internal space 9 of the inside rise portion 3. In this way, the inside rise portion 3 will increase in rigidity and become hard to deform when the outside rise portion 8 of the outer panel 6 is formed, and thereby it becomes possible to securely bond the inside and outside rise portions 3 and 8 to each other. As a result, the adhesion strength between both panels 1 and 6 will be increased. As shown in FIG. 7B, the outside rise portion 8 may extend beyond the inside rise portion 3 or, as shown in FIG. 7C, the outside rise portion may be bent along the inside rise portion 3. It goes without saying that the shapes of the forming surface 17 and the escape 18 of the main punch 16 have to be properly changed in order to obtain such an embodiment as shown in FIG. 7C.

Figure 8A:
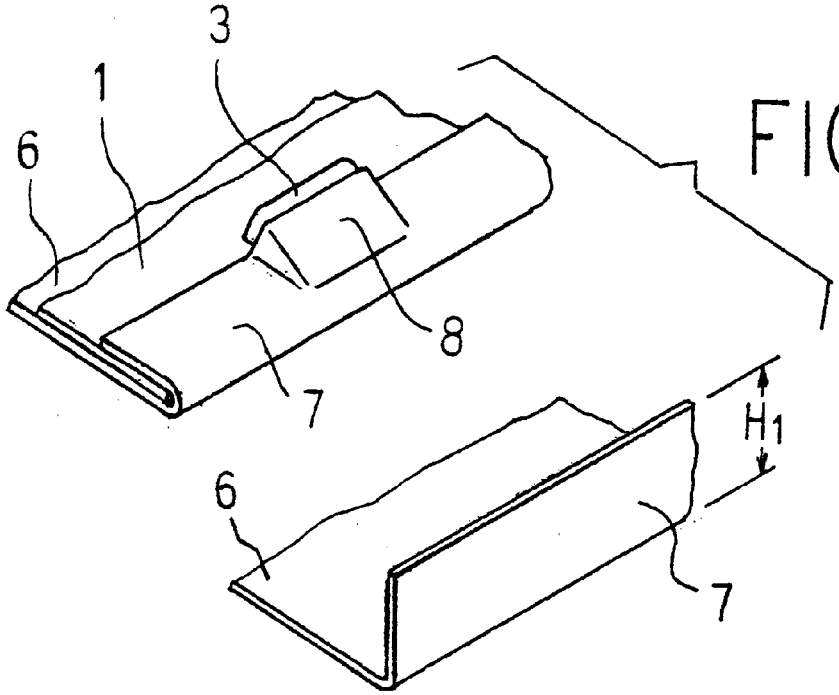
FIGS. 8A and 8B are perspective diagrams of an outside rise portion in different fashions.
Figure 8B:
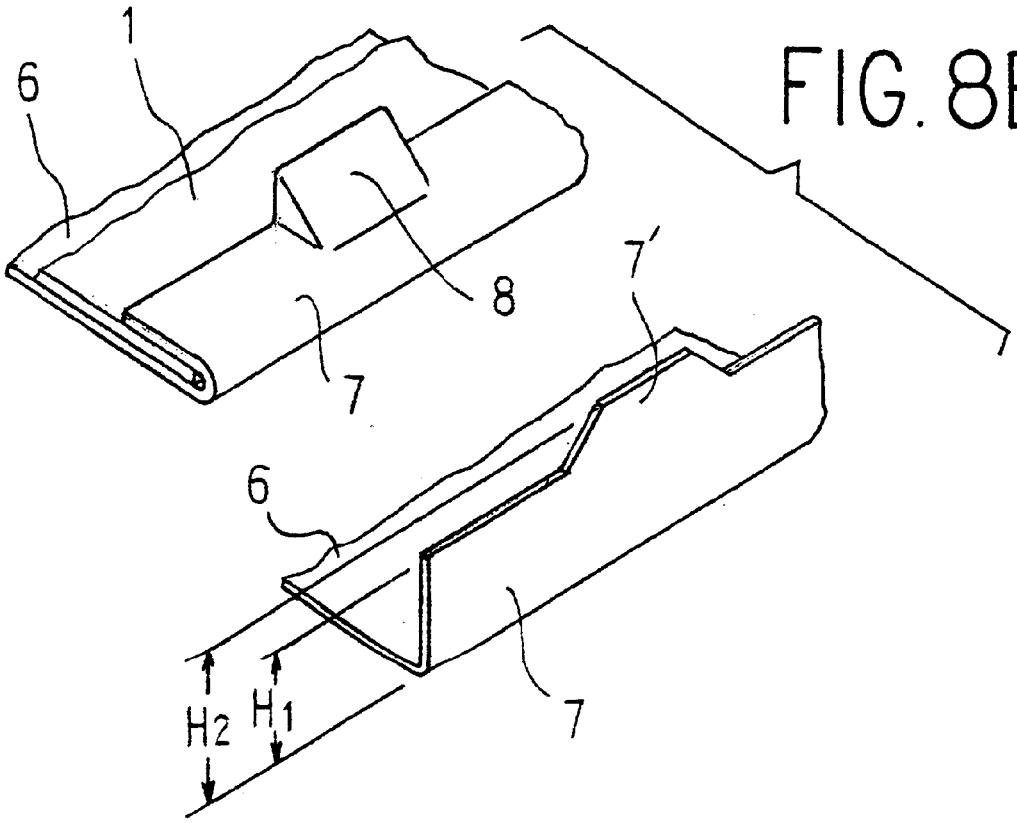

As shown in FIG. 8A, when the width H1 of the hem portion 7 formed by bending the outer panel 6 is constant, the form of the outside rise portion 8 will be as shown in FIG. 7A. As shown in FIG. 8B, a form of the outside rise portion 8 as shown in FIG. 7B may be obtained by providing a wider (H1<H2) portion 7' at a position corresponding to the inside rise portion 3 of the hem portion 7 of the outer panel 6.

Figure 9B:
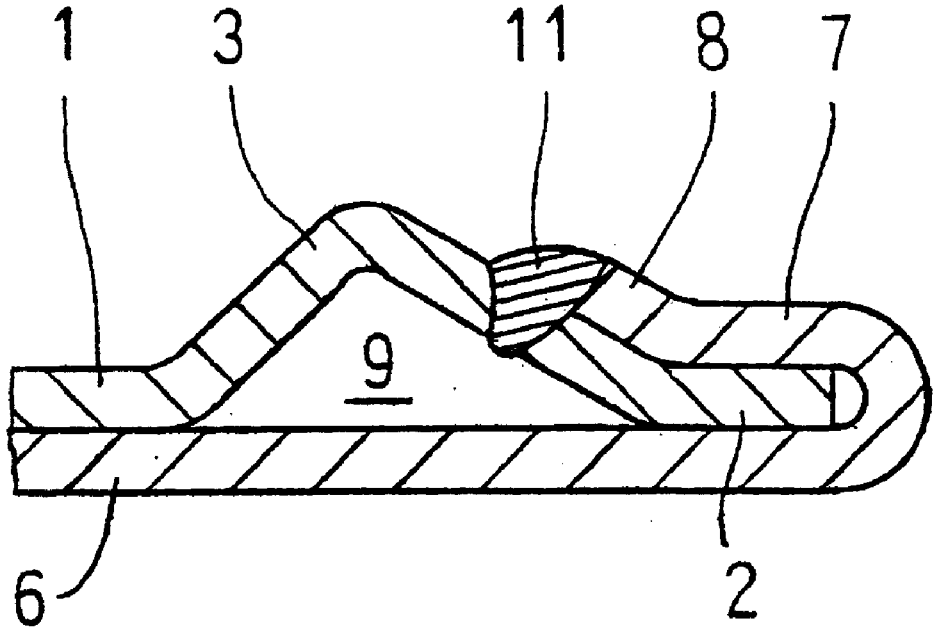
FIGS. 9A and 9B are cross-sectional views of embodiments with inside and outside rise portions welded to each other.
Figure 9A:
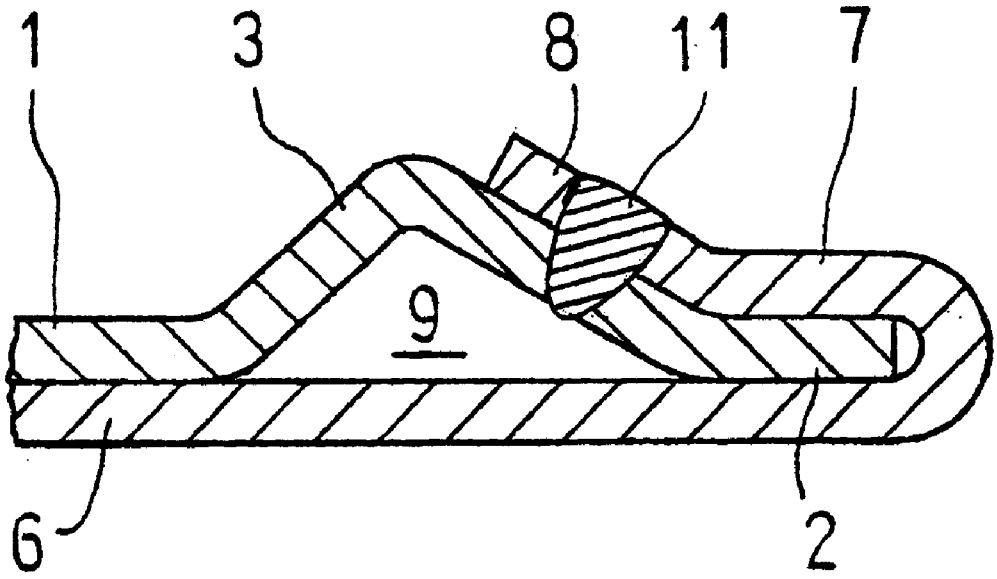

FIGS. 9A and 9B show modified embodiments in which the inside and outside rise portions 3, 8 are welded, for example, by laser welding as shown by reference numeral 11. In the case of FIG. 9A, the overlap of the rise portions 3 and 8 is welded, so that the welding point can be freely determined within the plane of the rise portions 3, 8, faciliating the welding operation as compared with the case of welding a spherical dimple in prior art. In the case of FIG. 9B, welding is aimed at the edge of the folded portion of the outer panel 6. This is advantageous in that the melting volume is less and consequently the time required for welding can be shortened. When the position of the edge portion is variable in connection with the press accuracy, for example, a means to detect the welding point or the edge portion may preferably be provided.

Figure 10:
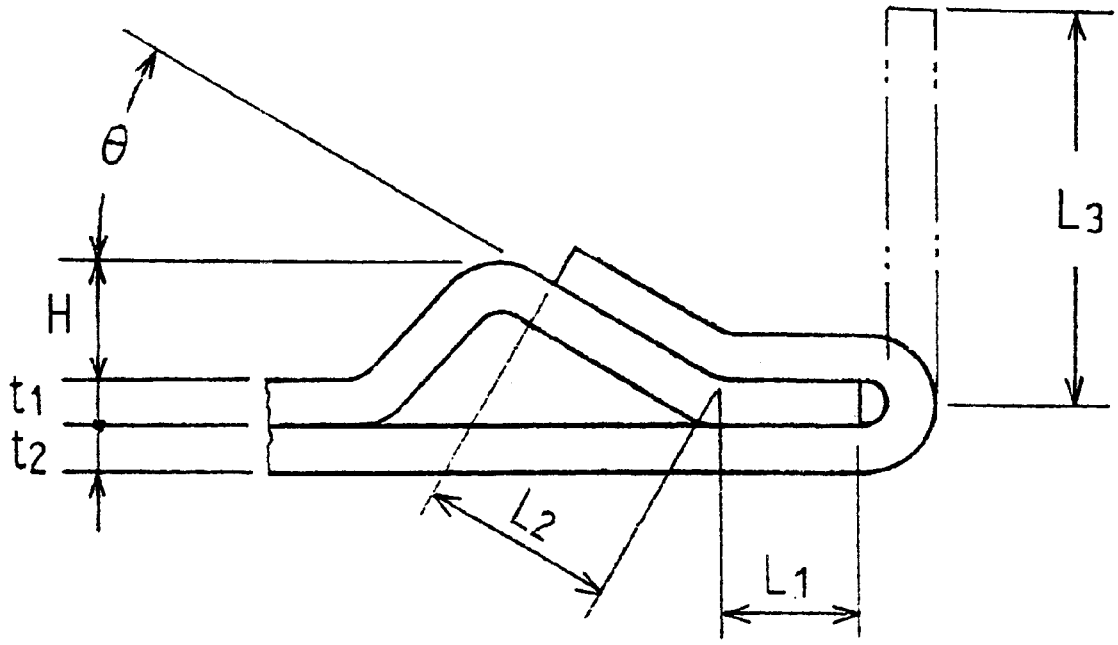
FIG. 10 is a cross-sectional view of an embodiment.

Referring to FIG. 10, the thickness of the inner panel 1 is shown as equal to that of the outer panel 6. In the case of a door panel for automobiles, usually, the thickness t1 of the inner panel 1 ranges from 0.67 to 0.78 mm, while the thickness t2 of the outer panel 6 ranges from 0.67 to 1.0 mm. Practically, being outside these ranges is also allowable, for example, it is possible to use the inner panel 1 of t1=1.5 mm. The cross-section of the inside rise portion 3 has a triangular shape with a height h=approx. 1.5~2.0 mm. Let $L_1$ be the width of the edge portion of the inner panel 1, $L_2$ the width of the overlap of the inside and outside rise portions 3 and 8, and $L_3$ the width of the edge portion 7 formed by turning the outer panel 6, then each dimension is as follows:

$L_1$=approx. 4~6 mm, $L_2$=approx. 6~8 mm (approx. 3~4 mm at least), $L_3$=approx. 9~16 mm.

Here, angle θ has to be determined taking into account the weldability in case of welding as well as the workability and adhesion strength of the inside and outside rise portions 3, 8. To mention a specific example, the angle is. to be in a range of 15°~35° or preferably 20°~30°.

As is apparent in the above description, the present invention is able to completely prevent deflection of both inner and outer panels since they are securely retained by telescopically fitting inside and outside rise portions with each other. Furthermore, the rise portions are in plane-to-plane abutting relation with each other so that gaps are hard to be generated between the contacts and it is possible to weld the rise portions by laser welding. In addition, since a space is formed between the inside rise portion and the outer panel, there is no fear of affecting the outer panel surface by welding heat. Accordingly, the panels may be prevented from deformation resulting from thermal distortion. Also, it becomes unnecessary to finish the surfaces of weld zones, thereby improving the workability. The present invention also ensures excellent workability since an outside rise portion is fitted with an inside rise portion while the outside rise portion is formed during a process of complete hemming, making it possible to perform both forming and fitting operations at the same time, and also, it is not needed to make any adjustments such as centering of both rise portions.

What is claimed is:

1. A structure of hemmed together metal panels comprising:

an inner panel having an edge portion; and an outer panel having a straight portion and an edge portion hemmed over said inner panel edge portion, wherein said inner panel edge portion has an inside rise portion projecting away from said outer panel straight portion with a surface plane down-sloping towards an edge at and end of said inner panel edge portion, wherein said outer panel edge portion has an outside rise portion telescopically fitted to said inside rise portion of said inner panel, wherein said inside rise portion of said inner panel is partially encompassed by and nestled within said outside rise portion of said outer panel, wherein said outside rise portion has a back plane abutting on said surface plane of said inside rise portion of said inner panel, and wherein a triangular space is formed between said inside rise portion and said outer panel straight portion.

2. The structure of hemmed together metal plates according to claim 1, wherein a plane of said rise portions is rectangular.

3. The structure of hemmed together metal plates according to claim 2, wherein two sides of said rise portions diverge while approaching said edge of said inner panel.

4. The structure of hemmed together metal plates according to claim 1, 2, or 3, wherein said inside rise portion is welded to said outside rise portion.

5. The structure of hemmed together metal plates according to claim 1, wherein an internal space of said triangular space is filled with either one of a filler and a support.

6. The structure of hemmed together metal plates according to claim 1, wherein said inside rise portion of said inner panel is an inverted V-shape.

7. The structure of hemmed together metal plates according to claim 6, wherein a cross-section of said inverted V-shaped inside rise portion of said inner panel has a height between 1.5 mm to 2.0 mm.

8. A method of hemming together the inside rise portion and outside rise portion using the inner and outer panels of claim 1, a first lower die having a projection extending from an upper surface thereof corresponding to the inside rise portion, an upper die having a depression formed in a lower surface thereof corresponding to the projection of the lower die, a press block, a main punch having a forming surface formed in a lower surface thereof, the forming surface having an escape, and a second lower die, the method comprising:

placing the inner panel over the projection of the first lower die;

lowering the upper die onto the inner panel to form the inside rise portion;

removing the inner panel with the inside rise portion formed therein from the upper die and first lower die;

positioning the inner panel on top of the outer panel;

setting the inner panel and outer panel on the press block;

performing a pre-hemming step to turn the edge portion of the outer panel upward away from the press block a predetermined amount;

performing a complete hemming step to completely turn the edge portion of the outer panel by placing the inner and outer panels over the second lower die and lowering the main punch thereon to form the outside rise portion of the outer panel corresponding to the inside rise portion at a hem portion of the outer panel, wherein a caulking structure is created.

9. The method according to claim 8, wherein the inside rise portion of the inner panel is fitted within the outside rise portion of the outer panel at the caulking structure to interlock the inner and outer panels.

10. The method according to claim 8, further comprising applying an adhesive to the edge portions of the inner and outer panels before the pre-hemming is performed.

* * * * *